US008181311B2

(12) United States Patent
Chiang et al.

(10) Patent No.: US 8,181,311 B2
(45) Date of Patent: May 22, 2012

(54) ADJUSTABLE HINGED DOOR CLOSER

(75) Inventors: Chi-Tsao Chiang, Daxi Township, Taoyuan County (TW); Jack Huang, Daxi Township, Taoyuan County (TW); Jason Chang, Daxi Township, Taoyuan County (TW)

(73) Assignee: Heng Kuo Co., Ltd., Daxi Township, Taoyuan County (TW)

( * ) Notice: Subject to any disclaimer, the term of this patent is extended or adjusted under 35 U.S.C. 154(b) by 354 days.

(21) Appl. No.: 12/537,420

(22) Filed: Aug. 7, 2009

(65) Prior Publication Data

US 2011/0030167 A1 Feb. 10, 2011

(51) Int. Cl.
*E05F 1/08* (2006.01)

(52) U.S. Cl. ..... 16/78; 16/56; 16/72; 16/DIG. 9; 16/DIG. 10

(58) Field of Classification Search ..... 16/49, 51, 16/52, 56–58, 72, 78, 80, DIG. 9, DIG. 10, 16/DIG. 21, DIG. 39
See application file for complete search history.

(56) References Cited

U.S. PATENT DOCUMENTS

| | | | | | |
|---|---|---|---|---|---|
| 2,314,544 | A * | 3/1943 | Larson | 16/49 |
| 2,460,369 | A * | 2/1949 | Stronach | 16/56 |
| 2,471,707 | A * | 5/1949 | Van Veen et al. | 16/62 |
| 2,537,059 | A * | 1/1951 | Kalthoff | 16/52 |
| 2,700,175 | A * | 1/1955 | Carlson | 16/284 |
| 3,137,888 | A * | 6/1964 | Blom | 16/51 |
| 3,156,002 | A * | 11/1964 | Schmid | 16/79 |
| 4,773,125 | A * | 9/1988 | Watabe | 16/53 |
| 5,666,692 | A | 9/1997 | Toledo | |
| 6,493,904 | B1 | 12/2002 | Chiang | |
| 6,625,847 | B1 * | 9/2003 | Jones | 16/51 |
| 6,886,217 | B2 * | 5/2005 | Foster | 16/69 |
| 7,421,761 | B2 * | 9/2008 | Johnson | 16/60 |
| 2007/0234510 | A1 * | 10/2007 | Toledo | 16/72 |

* cited by examiner

*Primary Examiner* — Victor Batson
*Assistant Examiner* — Roberta Delisle
(74) *Attorney, Agent, or Firm* — Egbert Law Offices PLLC

(57) ABSTRACT

The present invention provides an adjustable hinged door closer, including a seat with the first and second cylinders, and a first and a second elastic linkage unit. A double-threaded regulator is incorporated onto the first connecting rod of the first elastic linkage unit, so as to change the compression of the spring and regulate the closing/restoring force of the door body. The double-threaded column of the double-threaded regulator has a double-thread that shifts to two thread pitches by just making one rotation, thus facilitating the fine-tuning easily. The elastic linkage unit and the regulator are structurally configured to be assembled externally, and then mated with the connecting seat of the door closer.

2 Claims, 8 Drawing Sheets

ADJUSTABLE HINGED DOOR CLOSER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an adjustable hinged door closer, and more particularly to an innovative door closer fitted with double-threaded regulator that can easily change spring compression for regulating rapidly and accurately the closing and restoring force of the door.

2. Description of Related Art Including Information Disclosed Under 37 CFR 1.97 and 37 CFR 1.98

A door closer is generally mounted onto the rotary shaft seat of a revolving door to control the closing speed of door panel.

As for the previous structure of the door closer, the opening or closing force of the door body cannot be regulated. That is to say, a spring mechanism is mounted into the door body such that the spring is compressed to accumulate energy and then released so as to control the closing speed via the energy and resistance. Such a typical door closer is available with several opening and closing forces depending on the size of the door body and the occasions. But there are some shortcomings, such as excessive opening resistance or insufficient closing force, which still exist due to different occasions and objects.

For the aforementioned reasons, an adjustable door closer has been developed, e.g. U.S. Pat. No. 5,666,692 discloses an adjustable door closer. This prior art has shortcomings. First, the stretching screw thereof is of a single-screw thread that requires a great number of turns for regulation, so time-consuming fine-tuning still exists during actual operation. Second, the stretching screw thereof is installed obliquely such that it has an included angle with internal tension member. With the increase of the rotating turns of the stretching screw, the tension member yields reverse tensile force for the stretching screw, so linear deformation max occur, leading to oil leakage arising from the gap between the stretching screw and the assembly hole. Also, the interior of the stretching screw must be mated with relevant members within the main body of the door closer, leading to difficult assembly, greater chances for defects and manufacturing costs.

There is also U.S. Pat. No. 6,493,904B1, by the present inventor, which has other shortcomings. First, the regulating members must be connected with the relevant members within the main body of the door closer, leading to difficult assembly, greater chances for defects and manufacturing costs. Also, the regulating lever is easily broken due to thermal treatment, making it difficult for repair.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

The present invention enables the shift of a double-threaded column of the double-threaded regulator to two thread pitches by just making one rotation, thus doubling the shift speed, the fine-tuning efficiency and available turns of regulation and stroke for realizing a regulation mode with several maximum opening angles within bigger range.

The present invention also includes first and second elastic linkage units and a double-threaded regulator mounted into the seat after external members are assembled. Then the first and second elastic linkage units are mated with the connecting seat through the punch hole of the actuating groove, thus making it easier and quicker to finish the assembly work. The present invention thoroughly resolves the internal assembly problem of typical structures, improving manufacturing efficiency and quality of the door closer with better industrial benefits. Furthermore, all compression and regulation mechanisms are arranged in parallel to the main axle of the piston, so the regulating movement and piston action run in parallel in conformity with the principle of practical mechanics.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
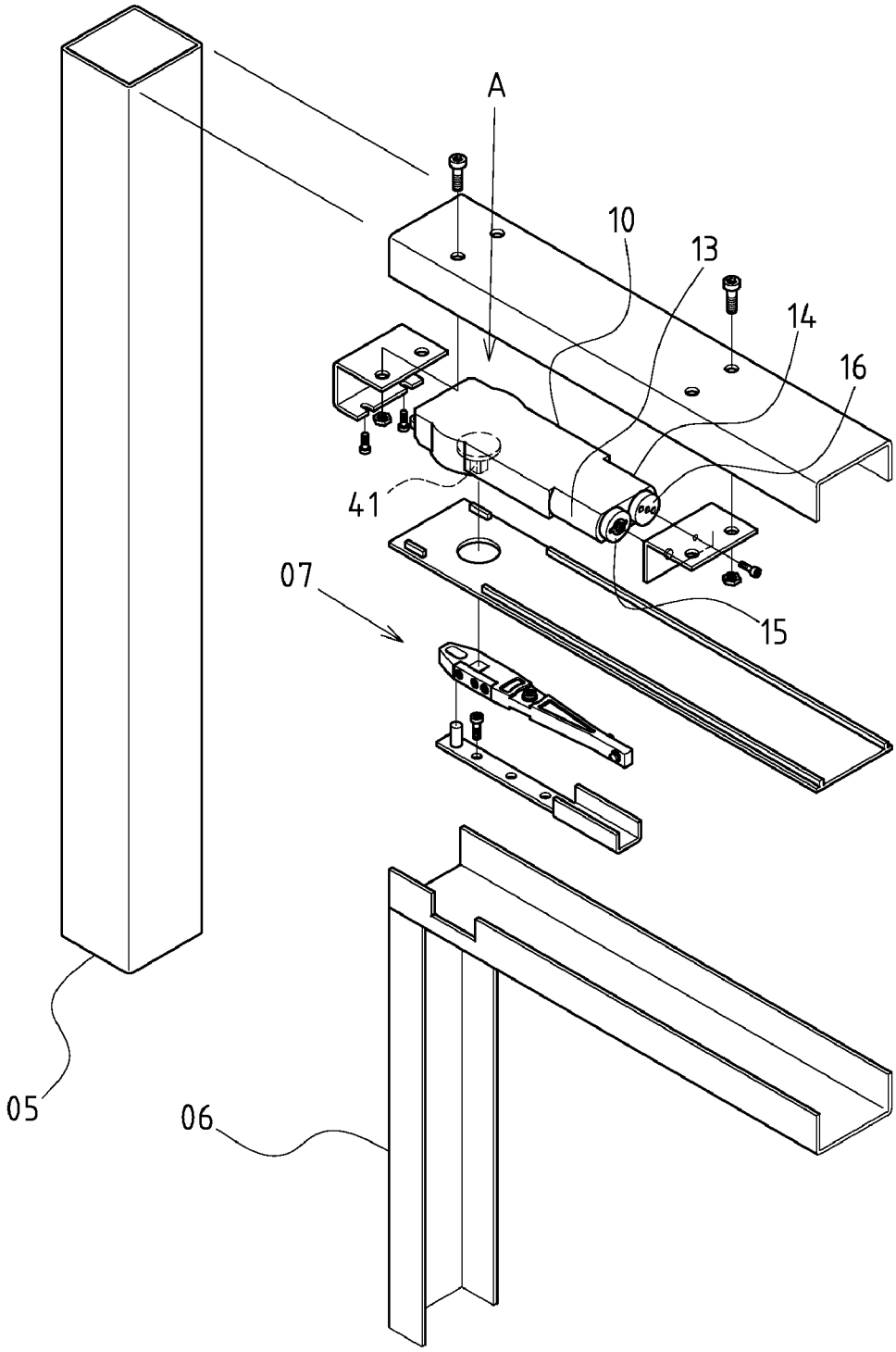
FIG. 1 shows an exploded perspective view of the preferred embodiment and the door frame of the present invention.

FIGS. 1, 2, 3, 8 and 9 depict preferred embodiments of an adjustable hinged door closer of the present invention. The embodiments are provided for only explanatory objectives with respect to the patent claims.

The adjustable hinged door closer A comprises a seat 10 with a hollow space, wherein a hydraulic chamber 11, an actuating groove 12, a first cylinder 13 and a second cylinder 14 in parallel are formed. The actuating groove 12 and the first/second cylinder 13, 14 are arranged separately at both ends of the hydraulic chamber 11. The first and second cylinders 13, 14 are provided with an end 130, 140. A first end cover 15 is screwed onto the end 130 of the first cylinder 13, and a second end cover 16 screwed onto the end 140 of the second cylinder 14.

Figure 2:
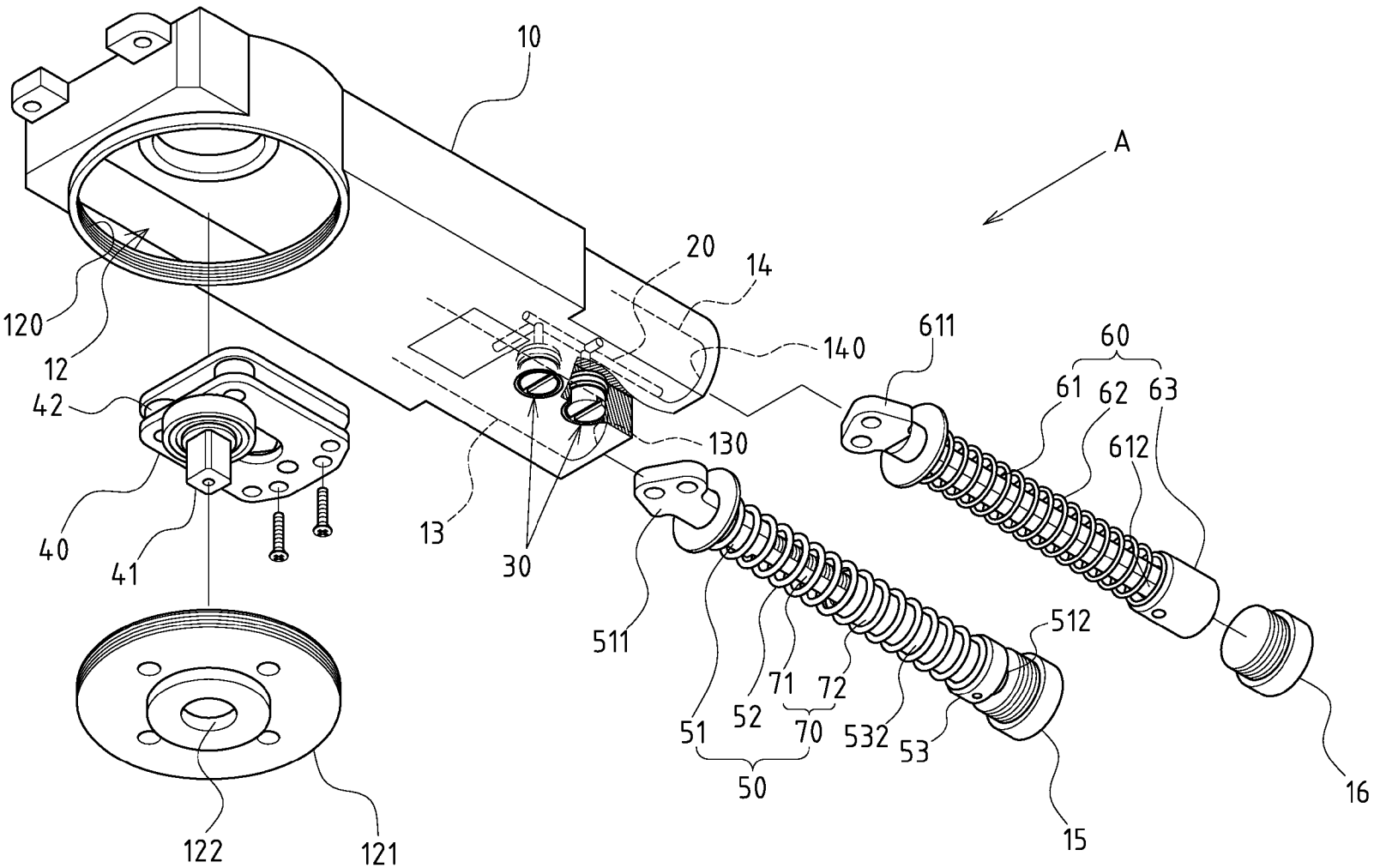
FIG. 2 shows an exploded perspective view of the preferred embodiment of the present invention.
Figure 3:
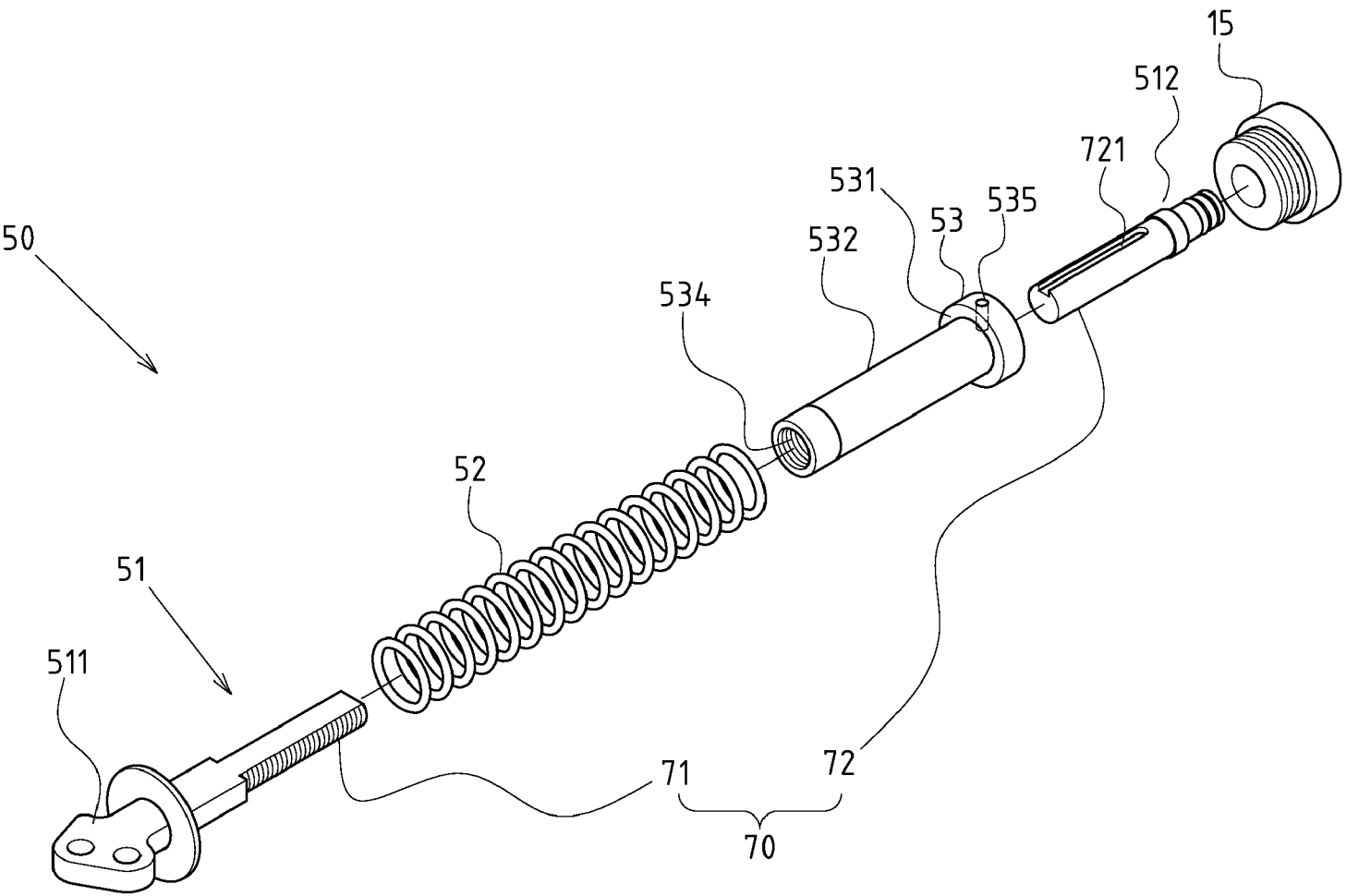
FIG. 3 shows an exploded perspective view of the first elastic linkage unit of the present invention.
Figure 7:
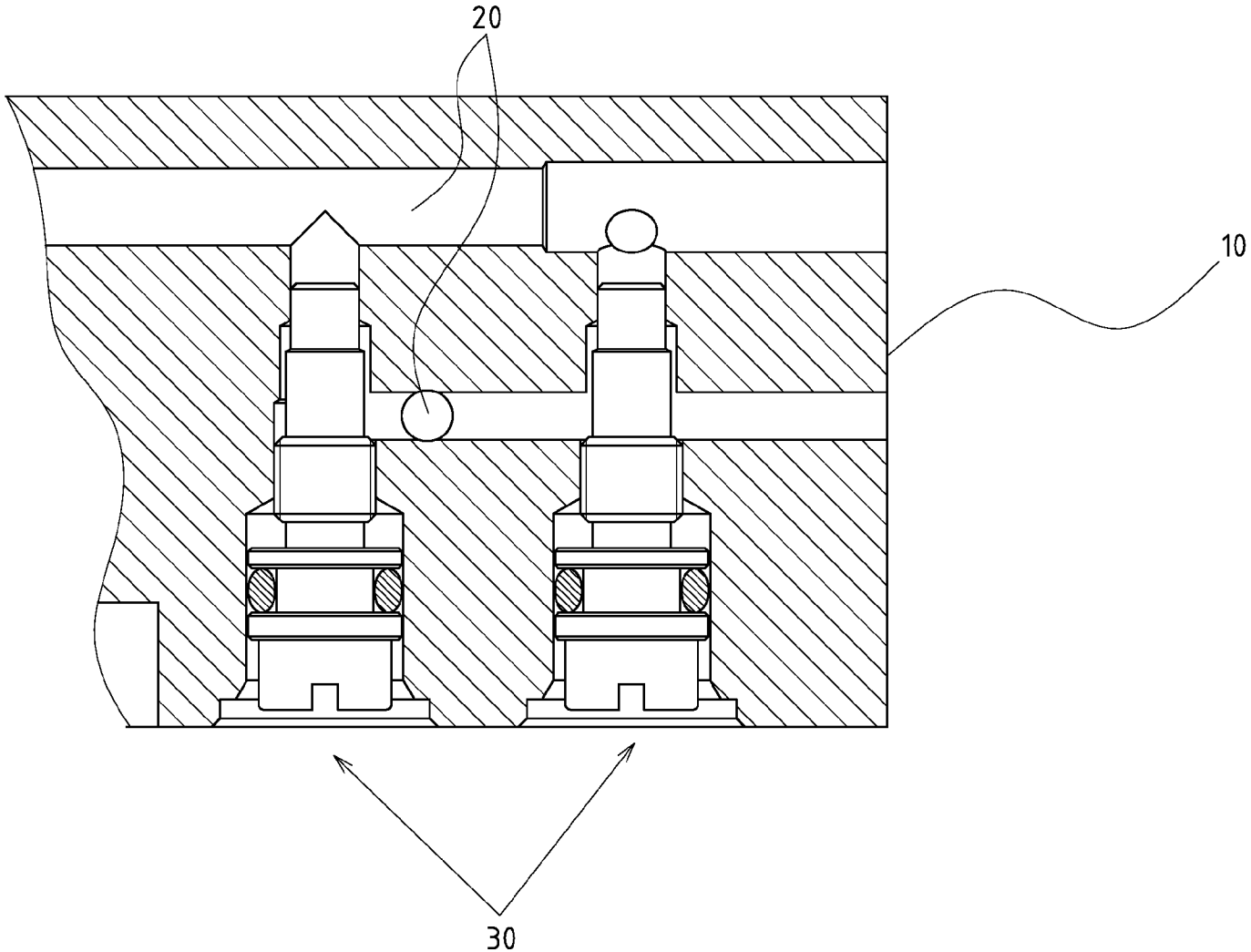
FIG. 7 shows an enlarged sectional view of an application of the present invention, showing the throttle valve assembled onto the connecting duct.

A connecting duct 20, referring to FIGS. 2, 7, is arranged between the first and second cylinders 13, 14, and used to connect the first/second cylinders 13, 14, enabling the flow of liquid within the first/second cylinder 13, 14.

A throttle valve 30 is placed on the connecting duct 20 for regulating the hydraulic pressure.

Figure 6:
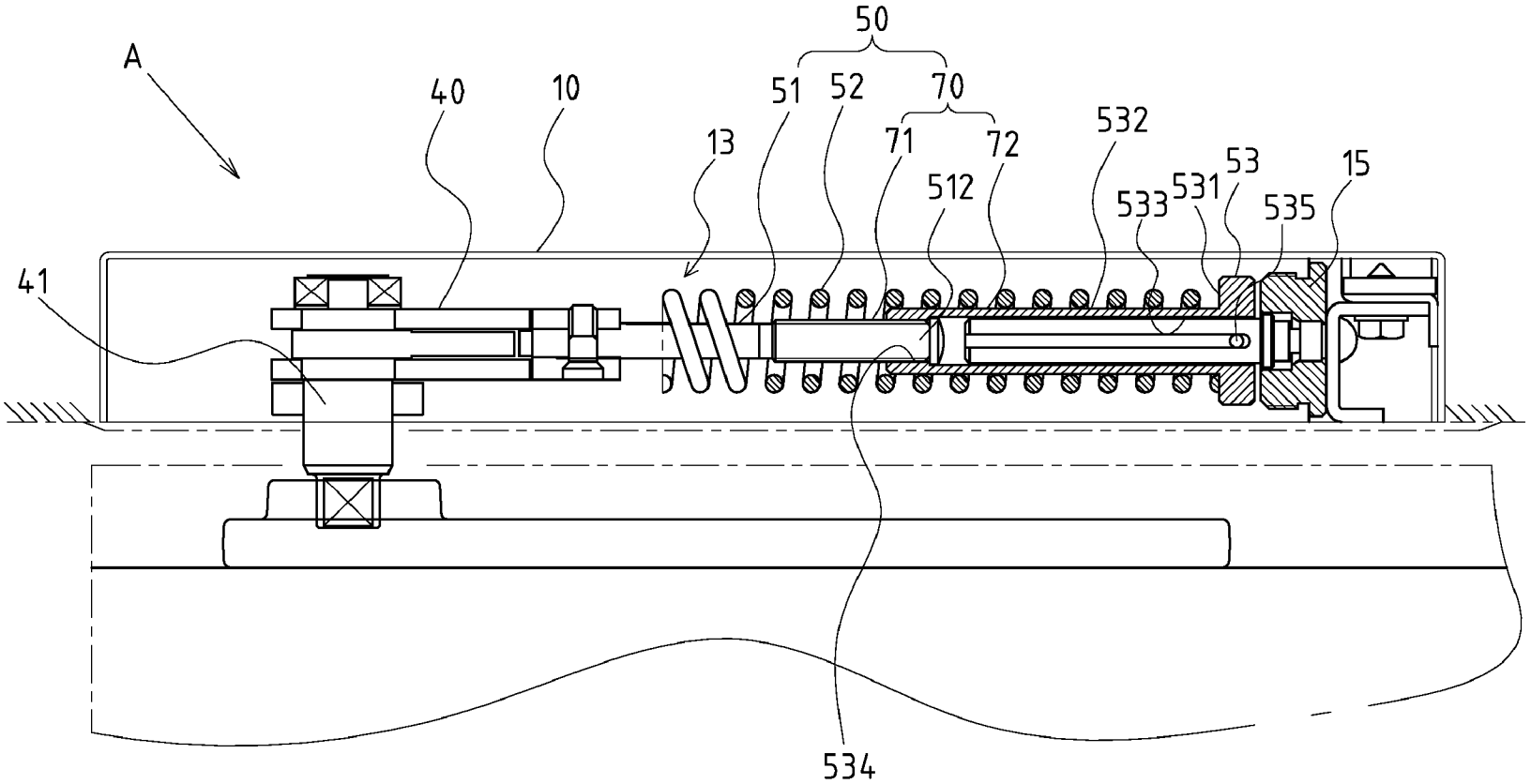
FIG. 6 shows a side sectional view of the preferred embodiment of the present invention.

A connecting seat 40 is assembled within the actuating groove 12 of the seat 10 in a swinging state. A pivot 41 is protruded from the bottom of the center of the connecting seat 40. Referring to FIGS. 1 and 6, since the adjustable hinged door closer A is embedded into the upper part of the door frame 05, the pivot 41 protruded from the connecting seat 40 is mated with a rocker arm 07 on the door body 06, thus forming an actuating rotary axis on the upper part of the door body 06. Moreover, the connecting seat 40 is fitted with two rollers 42, an auxiliary roller 43 and a cam 44. The pivot 41 and cam 44 are incorporated, and the pivot 41 can rotate freely, so the actuated cam 44 will push said roller 42 or auxiliary roller 43 to drive the connecting seat 40. Then, the first elastic linkage unit 50 and second elastic linkage unit 60 are pushed hereunder, such that the first spring 52 or second spring 62 is compressed to store the closing energy.

A first elastic linkage unit 50 contains a first connecting rod 51, a first spring 52 and a first piston 53. The interior 511 of the first connecting rod 51 is linked to the connecting seat 40, and the exterior 512 of the first connecting rod 51 linked to the first end cover 15. The first spring 52 is sleeved onto the periphery of the first connecting rod 51, while the first piston 53 is installed close to the exterior 512 of the first connecting rod 51, and located within the first cylinder 13 of the seat 10. The first piston 53 contains a circular retaining surface 531 and a hollow cylinder 532. A tank 533 is formed within the hollow cylinder 532, and internally provided with a recessing tapped hole 534.

A second elastic linkage unit 60 contains a second connecting rod 61, a second spring 62 and a second piston 63. The interior 611 of the second connecting rod 61 is linked to the connecting seat 40, and the second spring 62 is sleeved onto the periphery of the second connecting rod 61, while the second piston 63 is installed at the exterior 612 of the second connecting rod 61 and located within the second cylinder 14 of the seat 10. Moreover, the second piston 63 is arranged at intervals corresponding to the second end cover 16.

Figure 4:
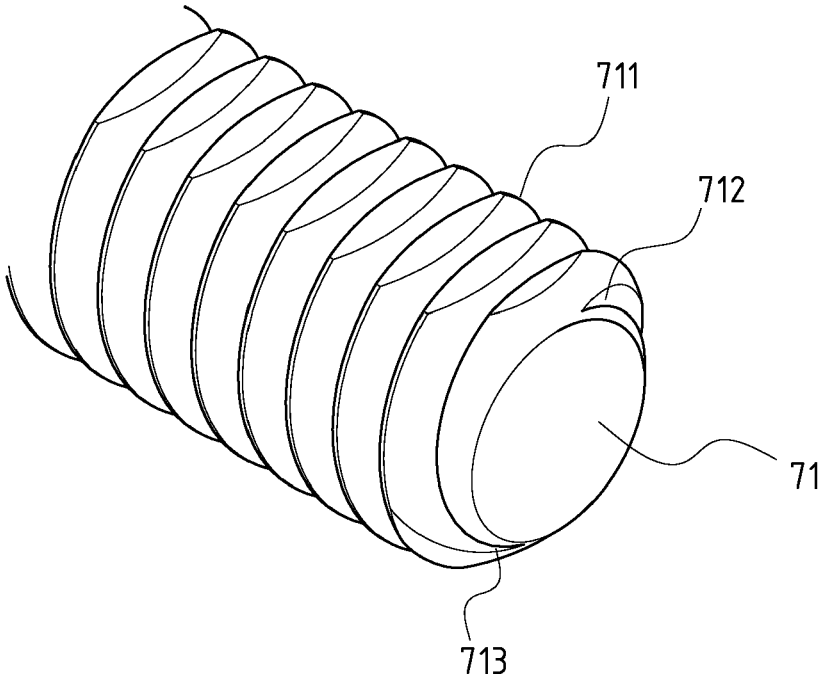
FIG. 4 shows an enlarged perspective view of the double-threaded column of the present invention.
Figure 5:
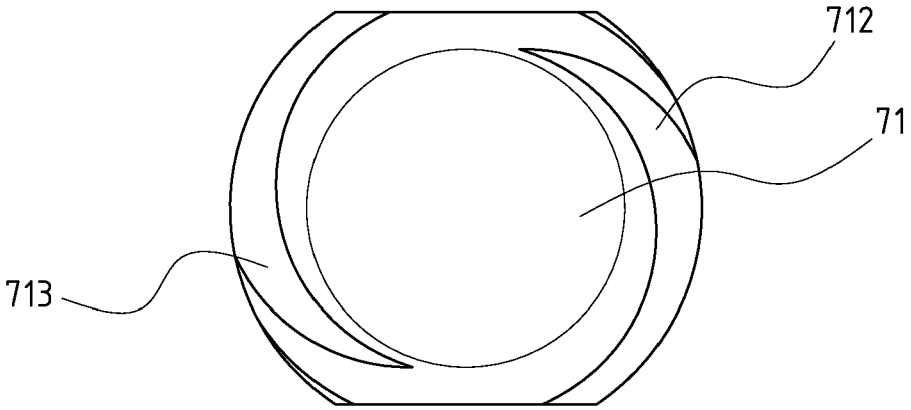
FIG. 5 shows a front elevation view of the double-threaded column of the present invention.
Figure 10:
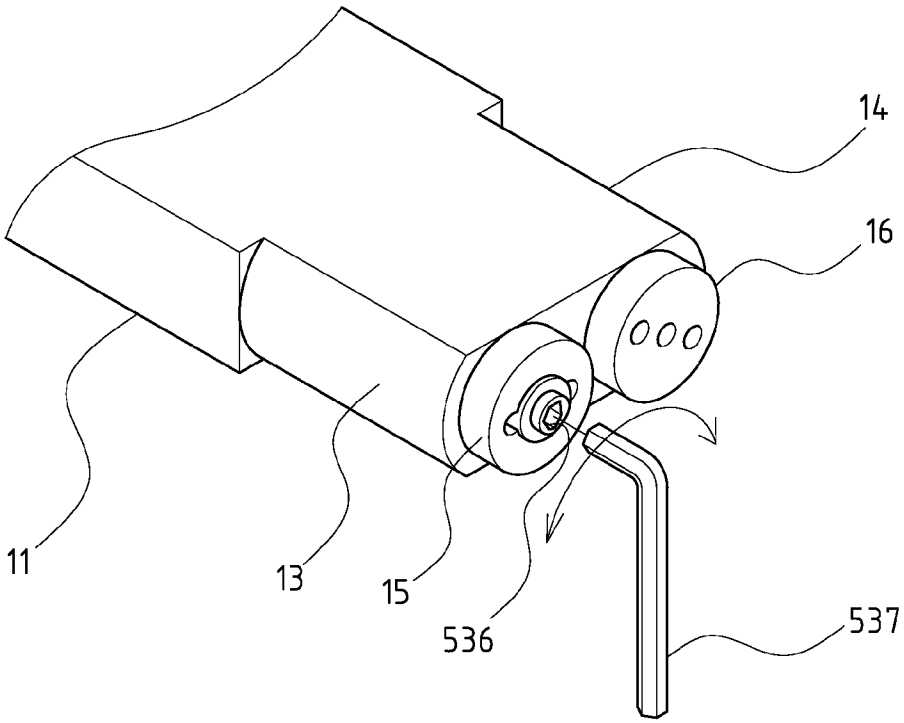
FIG. 10 is a partial perspective view of the present invention, showing the hexagon spanner inserted into the tool driving portion.

A double-threaded regulator 70 is incorporated onto the first connecting rod 51 of the first elastic linkage unit 50 and used to regulate the compression of the first spring 52 set for the first elastic linkage unit 50. The double-threaded regulator 70 comprises a double-threaded column 71, which is connected to the interior 511 of the first connecting rod 51. The double-threaded column 71 is provided with a double-thread 711 that shifts to two thread pitches by just making one rotation, and the end of the double-threaded column 71 is available with two threaded cutting portions 712, 713 (shown in FIGS. 4, 5). Furthermore, the end of the double-threaded column 71 is screwed with the tapped hole 534 set within the tank 533 of the first piston 53. A rotating lever 72 is assembled into the tank 533 of the hollow cylinder 532 of the first piston 53. Straight groove 721 and bulge 535 are embedded between the rotating lever 72 and the tank 533, so that the rotating lever 72 can drive the first piston 53 to rotate simultaneously. A tool driving portion 536 penetrating the first end cover 15 is set externally onto the rotating lever 72. Referring to FIG. 10, the tool driving portion 536 is of a hexagonal hole for inserting and driving a hexagon spanner 537.

Figure 8:
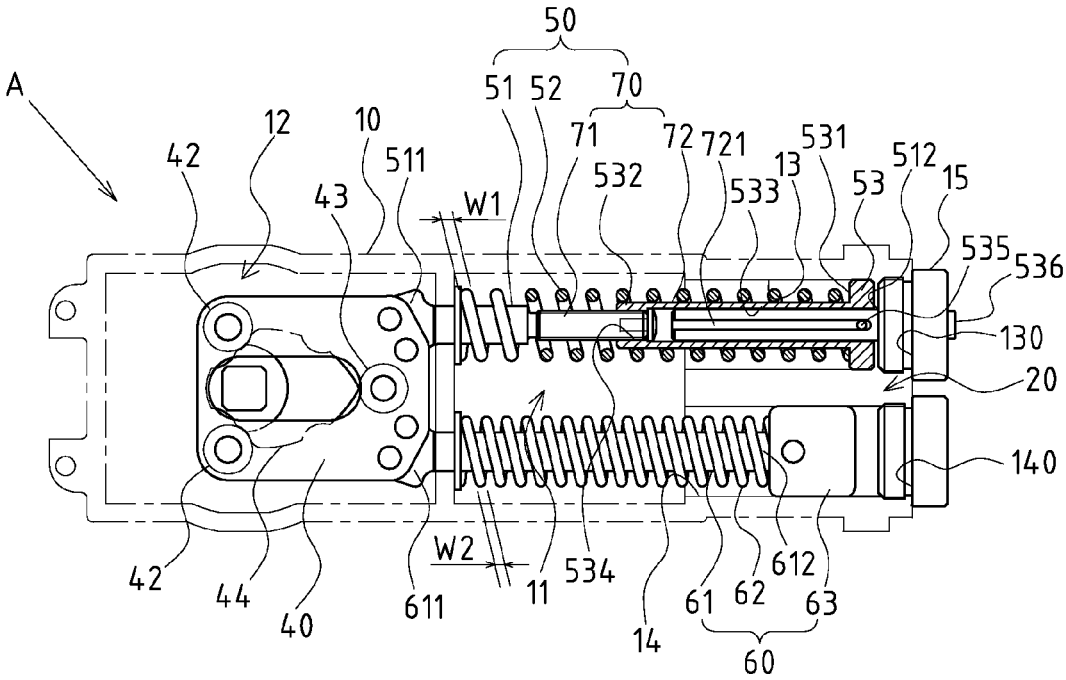
FIG. 8 shows a sectional view of an application of the present invention, showing the first and second elastic linkage units as assembled onto the first and second cylinders.

Referring also to FIG. 8, the external diameter of the first spring 52 (W1) is bigger than that of the second spring 62 (W2). As the second elastic linkage unit 60 of a pure linkage structure lacks adjustability, but the first elastic linkage unit 50 that incorporates the double-threaded regulator 70 enables adjustment of the first spring 52, the adjustability of the second elastic linkage unit 60 can reach a bigger range due to the external diameter of the first spring 52 bigger than that of the second spring 62.

The ends 130, 140 of the first and second cylinders 13, 14 can be designed into an internal thread structure, so that the first and second end covers 15, 16 are fitted with external thread for screwing of the first and second end covers 15, 16.

Referring to FIG. 2, a punch hole 120 is set at one side of the actuating groove 12 of the seat 10 and used to screw a limitation cover plate 121. At the center of the limitation cover plate 121, a through-hole 122 is set for the penetration of the pivot 41 of the connecting seat 40.

Based upon above-specified structures, the adjustable hinged door closer A of the present invention is operated as follows:

When the adjustable hinged door closer A is used, the hydraulic chamber 11, first cylinder 13 and second cylinder 14 within the seat 10 are full of hydraulic liquid. When the door body 06 is opened, the rocker arm 07 on the door body 06 will rotate the pivot 41, such that the cam 44 will push the roller 42 or auxiliary roller 43 to drive the connecting seat 40, then push the first elastic linkage unit 50 and second elastic linkage unit 60. So, the first spring 52 or second spring 62 is compressed to store the closing energy. In such a case, the hydraulic liquid at the left hand of the second piston 63 will be filled via a check valve into a right-hand space of the second piston 63 formed due to its shift. When the door body 06 is released, the hydraulic liquid at the right-hand of the second piston 63 has to flow back to the left-hand space via the throttle valve 30 on the connecting duct 20. In such a case, if the throttle valve 30 is screwed for falling down, then the closing speed will slow down. Otherwise, if the throttle valve 30 is loosened for going up, the closing speed will be quickened.

Figure 9:
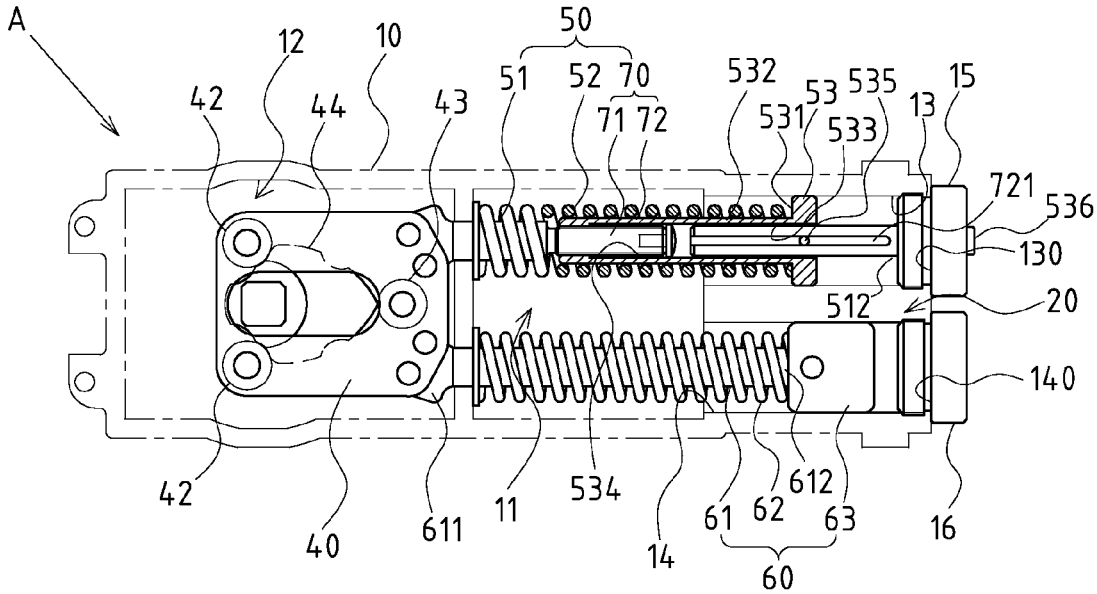
FIG. 9 shows a sectional view of the actuation of the present invention, showing the first piston moving forward axially.

One core element of the adjustable hinged door closer A of the present invention lies in that the double-threaded regulator 70 can be used to regulate the compression of the first spring 52 of the first elastic linkage unit 50. The first spring 52 regulates the restoring force depending on the width of the door body 06 required by the users; namely, the hexagon spanner 537 can be inserted into the tool driving portion 536 of the rotating lever 72 (shown in FIG. 10), so as to drive the first piston 53 simultaneously. Since the tapped hole 534 within the first piston 53 is screwed with the double-threaded column 71, and the straight groove 721 and bulge 535 are embedded between the rotating lever 72 and the tank 533 of the first piston 52, the rotating lever 72 can thus be rotated forward and reverse to drive the first piston 53 to move forwards or backwards axially, thereby regulating the compression of the first spring 52 as shown in FIGS. 8, 9. The compression of the first spring 52 shown in FIG. 9 is bigger than that of the first spring 52 shown in FIG. 8. When the compression of the first spring 52 becomes longer and the load is relatively reduced, the opening or closing force is weakened. The present invention is mostly characterized by the double-threaded column 71 of the double-threaded regulator 70 being provided with a double-thread 711 that shifts to two thread pitches by just making one rotation. This one rotation doubles the shift speed, the fine-tuning efficiency and available turns of regulation and stroke.

Figure 11:
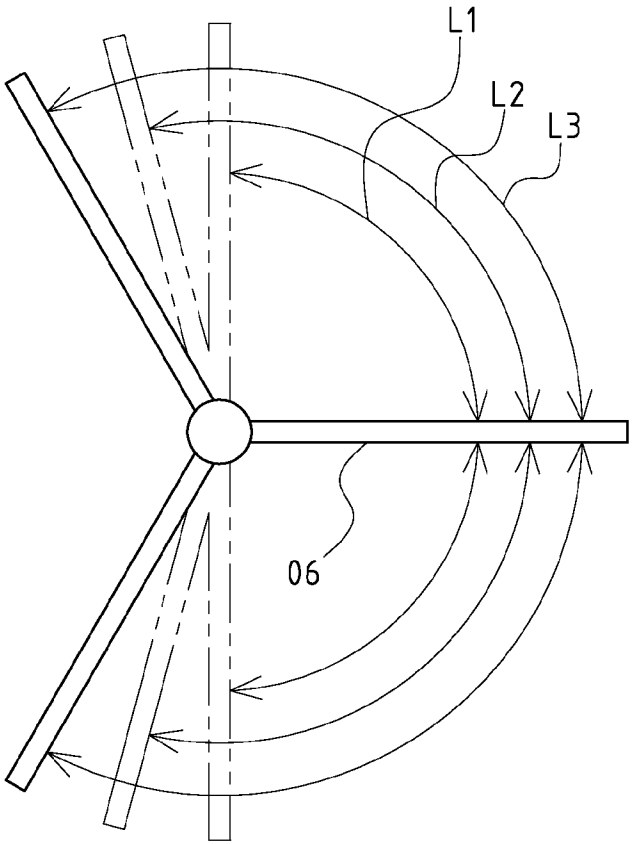
FIG. 11 shows a schematic view of the present invention, showing the door body reaching a maximum opening angle.

On the other hand, since the available turns of regulation and stroke of the double-threaded regulator 70 are doubled over the typical structure, the adjustable hinged door closer A of the present invention enables the maximum opening angle of the door body 06 to become superior to the typical structure. Referring to FIG. 11, the maximum opening angle of the door body 06 of the present invention is available with 90° (marked by arrow L1), 105° (marked by arrow L2) and 130° (marked by arrow L3), thereby meeting the diversified customer requirements.

The second core element of the adjustable hinged door closer A of the present invention lies in that, referring to FIG. 2, the actuating groove 12 and the first and second cylinders 13, 14 within the seat 10 are separately arranged at both ends of the hydraulic chamber 11. Moreover, the first and second cylinders 13, 14 are available with the ends 130, 140, and the actuating groove 12 is provided with a punch hole 120 for locking the limitation cover plate 121. Besides, the double-threaded regulator 70 is incorporated onto the first connecting rod 51 of the first elastic linkage unit 50. After external members are assembled, the first and second elastic linkage unit 50, 60 and the double-threaded regulator 70 can be mounted into the seat 10 from the ends 130, 140 of the first/second cylinders 13, 14. Then, the first and second elastic linkage units 50, 60 are mated with the connecting seat 40 through the punch hole 120 of the actuating groove 12. Next, the limitation cover plate 121 and the first and second end covers 15, 16 are screwed together to finish the internal assembly of the seat 10 as a way of resolving the internal assembly problem of typical structure.

We claim:

1. An adjustable hinged door closer apparatus comprising:

a seat having a hollow space, said hollow space having a hydraulic chamber and an actuating groove and a first cylinder and a second cylinder therein, said first cylinder being in parallel relation to said second cylinder, said actuating groove positioned at one end of said hydraulic chamber, said first cylinder and said second cylinder being positioned separately at an opposite end of said hydraulic chamber, said first cylinder having a first end cover screwed into an end thereof, said second cylinder having a second end cover screwed into an end thereof;

a connecting duct arranged between said first cylinder and said second cylinder, said connecting duct connecting said first cylinder and said second cylinder;

a throttle valve positioned on said connecting duct so as to regulate hydraulic pressure;

a connecting seat assembled within said actuating groove of said seat so as to be swingable in relation thereto, said connecting seat having a pivot protruding from a center thereof;

a first elastic linkage unit having a first connecting rod and a first spring and a first piston, said first connecting rod having an interior linked to said connecting seat, said first connecting rod having an exterior linked to said first end cover, said first spring being sleeved onto a periphery of said first connecting rod, said first piston positioned adjacent to said exterior of said first connecting rod and positioned within said first cylinder of said seat, said first piston having a circular retaining surface and a hollow cylinder, said hollow cylinder having a tank formed therein, said tank having an internal tapped hole;

a second elastic linkage unit having a second connecting rod and a second spring and a second piston, said second connecting rod having an interior linked to said connecting seat, said second spring sleeved onto a periphery of said second connecting rod, said second piston installed at an exterior of said second connecting rod and located within said second cylinder of said seat, said second piston in spaced relation to said second end cover;

a double-threaded regulator incorporated onto said first connecting rod of said first elastic linkage unit, said double-threaded regulator having a double-threaded column connected to said interior of said first connecting rod, said double-threaded column having a double-thread that shifts to a pair of thread pitches during a single rotation, said double-threaded column having a pair of threaded cutting portions at an end thereof, said end of said double-threaded column screwed into said tapped hole of said tank of said first piston; and a rotating lever assembled into said tank of said hollow cylinder of said first piston, a straight groove and a bulge being embedded between said rotating lever and said tank, said rotating lever driving said first piston so as to rotate simultaneously, said rotating lever having a tool drivingly penetrating said first end cover and positioned externally thereto, said first spring having an external diameter that is greater than an external diameter of said second spring, said actuating groove of said seat having a punch hole at one side thereof, said punch hole threadedly receiving a limitation cover plate, said limitation cover plate having a through-hole at a center thereof, said through-hole receiving said pivot of said connecting seat.

2. The apparatus of claim 1, said first cylinder having an internal thread at an end thereof, said second cylinder having an internal thread at an end thereof.

* * * * *